United States Patent [19]

Whelan

[11] Patent Number: 4,483,018

[45] Date of Patent: Nov. 13, 1984

[54] HIGH INTEGRITY TAMPER RESISTANT CONTAINER

[75] Inventor: John W. Whelan, Wynnewood, Pa.

[73] Assignee: Impakt Products, Inc., Narberth, Pa.

[21] Appl. No.: 527,196

[22] Filed: Aug. 29, 1983

Related U.S. Application Data

[63] Continuation of Ser. No. 232,649, Feb. 9, 1981, abandoned.

[51] Int. Cl.[3] ..... B65D 73/34

[52] U.S. Cl. ..... 383/5; 229/81

[58] Field of Search ..... 383/5; 229/70, 72, 81; 206/807

[56] References Cited

U.S. PATENT DOCUMENTS

| | | | |
|---|---|---|---|
| 1,045,001 | 11/1912 | Delffs | 229/81 |
| 2,215,989 | 9/1940 | Wolf | 229/62 |
| 2,226,943 | 12/1940 | Doppe | 229/62 |
| 3,070,280 | 12/1962 | Richmond | 229/62 |
| 3,111,256 | 11/1963 | Hiersteiner | 229/72 |
| 3,307,773 | 3/1967 | Kratzer et al. | 229/62 |
| 3,310,225 | 3/1967 | Hoblit et al. | 229/62 |
| 3,512,457 | 5/1970 | Watanabe | 229/62 |
| 3,933,304 | 1/1976 | Judd | 229/62 |

FOREIGN PATENT DOCUMENTS

| | | | |
|---|---|---|---|
| 1025034 | 4/1966 | United Kingdom | 229/62 |
| 1380727 | 1/1975 | United Kingdom | 229/62 |
| 2032882 | 5/1980 | United Kingdom | 229/62 |

*Primary Examiner*—Stephen P. Garbe

*Attorney, Agent, or Firm*—Wegner & Bretschneider

[57] ABSTRACT

A high integrity, tamper resistant container, preferably comprised of an opaque or transparent, high shear and impact resistant, plastic material. The container has an item insertion access opening. Closing and sealing means for the opening consist of removably covered, pressure sensitive adhesive material, applied on opposed mateable surface portions of the container proximate the access opening. Operative mating of the adhesive material on the mateable surfaces, subsequent to exposure, bonding the surfaces together, and closing and sealing the access opening in a substantially permanent and temperproof condition. Subsequent access to the sealed container necessitates a rupturing of the container, material thereof, or sealing adhesive. Tamper attempt indicating means, in the nature of distortable visible indicia can be provided. Identification means, in portionally removable duplicate, if desired, can be incorporated on the container to facilitate ownership, or content, identification or verification.

2 Claims, 11 Drawing Figures

MASTER DEPOSIT SLIP
DUPLICATE DEPOSIT SLIP
DUPLICATE DEPOSIT SLIP
DUPLICATE DEPOSIT SLIP
DUPLICATE DEPOSIT SLIP
ACCOUNTING FILES
BANK OR BANK NIGHT DEPOSIT
NO. 123

HIGH INTEGRITY TAMPER RESISTANT CONTAINER

This application is a continuation of U.S. application Ser. No. 232,649, filed Feb. 9, 1981, now abandoned.

TECHNICAL FIELD

The invention relates generally to containers adapted for a single time use, being thereafter disposable. The container is virtually tamperproof, subsequent to placement therein of items, and sealing of an access opening. Tamper indicating and identification means can be included. The container is designed to be non-reusable, inexpensive, security proficient, and ideally suitable for use, for example, as bank night deposit bags, and content sealed containment and safeguarding for items in various conditions and fields of use. User and content identification indicia can be readily incorporated in the container.

BACKGROUND OF THE INVENTION

Containers of numerous types, for containment of varied items and in numerous fields have been heretofore devised and used. Normally the container is specifically designed for a particular type of use and to provide certain desirable end features or characteristics in use.

Containers have heretofore been known and used which incorporated features for security or integrity of the container and the contents thereof. Some such containers were complex in form, expensive to manufacture, of a nature requiring multiple handlings and interchange between initial users and those having access to the container content for their use and/or recording purposes and the like.

Heretofore, however, there have not been readily available containers having, compositely, the elements of security, strength, low initial cost, ease of handling, elimination of complex closure and security means and which provided for economies of handling time in various fields of usage. In many such areas of use, it is highly desirable that a container be available which will satisfy the needs such as for bank night depositories, hospitals and medical facilities for sterility, integrity, identification and insurance of a non-contaminated single usage.

Other uses where security of personal or negotiable property is of a vital nature or consideration, such as in police departments, hotels, brokerage houses, legal documents such as wills, registered mail, and many other possibilities, all require containers having high integrity and security in use, while providing the same in a facile and relatively inexpensive manner.

While the present invention will be specifically described in one form, as a money container for customers of banks in a bank's night depository system, it is obviously not limited to such a principal function. In this connection, however, the most commonly used container currently consists of a bag of woven cloth material having a built-in lock. The customer or user of this bank bag normally has one key to the lock, and the bank at least another one or a master key, so that following deposit of a bag by a customer in a night depository system, the bag can be opened by bank personnel and necessary record entries, etc. be made.

It is well known that presently used devices are not only expensive in manufacture, but that the containers themselves are subject to deterioration, and following use by a customer in a bank night depository system, the bag or container must be returned to the customer for subsequent use. This interchange involves a substantial time element by bank and/or customer personnel.

It is also known that locks, depending upon the degree of sophistication of the locking mechanism, with comparable increases in cost of highly sophisticated mechanisms, are still subject to being compromised by persons skilled in such types of endeavors.

It is therefore a primary purpose of the present invention to provide a container which will satisfy needs of various types of users and industries and with a minimization of heretofore existing drawbacks. In essence, it is a desire of the present invention to provide a container having high integrity and which is tamper resistant in use. The container preferably is inexpensive in initial manufacture, utilizing, preferably, an opaque or transparent, high shear and impact resistant, plastic material. The bag in use has an access opening which is closable and sealable by its user. The sealing means consists of pressure sensitive adhesive material applied on surfaces adjacent to the access opening and which are mateable when it is desired to close and seal the container. This pressure sensitive adhesive material, when once mated with identical material on another surface, is virtually permanent and tamper-proof. This renders the container difficult for subsequent access to the interior thereof, and contents therein, in the absence of a rupturing or destruction of the container, its material or the sealing adhesive.

As will be seen, the present invention also provides for ready indication of attempts to tamper or otherwise open the container by the use of distortable visible indicia or the like.

In order to satisfy needs in various endeavors or businesses, it is of the essence that ownership of a container, and its contents, be readily identifiable and verifiable. The present invention as will appear hereinafter satisfies these latter needs as well as the foregoing.

As will be noted in the following detailed description and disclosure of a single preferred embodiment of the invention, the container of the invention provides not only the features of security as above mentioned, but additionally the container is designed and intended for a single use, thereafter being disposable since the container is basically non-reusable by virtue of the closure being non-resealable, and destruction of the container having been incurred in attempted opening for access thereinto.

SUMMARY OF THE INVENTION

The present invention is broadly directed to a container constructed of plastic material having high strength and impact resistant characteristics. The container is substantially closed with the exception of an initial access opening to permit insertion of materials into the container. Closure means are provided for this access opening which are of such a nature that, once the access opening has been closed and the sealing means actuated, a high degree of integrity is incorporated in the container with the access having a substantially permanent tamper-proof closure thereof.

The resultant container or bag structure, following this closure and sealing, necessitates a cutting or other destructive action to reopen the container, and no access is allowed through the initial sealed opening which has been very effectively, completely and securely sealed, with a high integrity of the resultant package.

The container is preferably provided, in the sealing area proximate the access opening, and even extending therethrough or thereacross, coacting visible means of such a nature that, if physically partially or totally moved, or one portion thereof is distorted or displaced with respect to another portion, such movement will visually disclose an attempt to tamper with or open the so-sealed container. Such means can consist in properly oriented or mated indicia, including but not restricted thereto, numerical, alphabetical or other user identification means, functional designations, and the like.

Over and above the foregoing, it is an intention of the present invention to provide containers of the described nature and which further can contain such indicia as to provide ready identification of the container and its inclusion in a given sequence of use or the like. This latter, in addition to others of the features hereinabove mentioned, is of substantial use when the container is to be used in connection with a bank night depository system or in any other application where container substitution is to be avoided.

The simplicity and inexpensive construction in conjunction with the security and tamper-proof features, constitute a substantial contribution to the art and the invention is susceptible of usage in many different fields of commerce. The elements of security, strength, low cost, ease of handling and elimination of time consuming handling, elimination of special opening means, provide a highly desirable product not only for the primary designed market, i.e., usage by banks but in all other incidental markets where security of personal or negotiable property is a vital consideration.

Other objects and advantages of the present invention will become readily apparent to those skilled in the art from the following detailed description, wherein there is shown and described only a single preferred embodiment of the invention, simply by way of illustration of a best mode currently contemplated for carrying out the invention. As will be realized, the invention is capable of other and specific embodiments, and its several details are capable of modification in various, obvious respects, all without departing from the invention. Accordingly, the drawings and description are to be regarded as merely illustrative in nature, and not as restrictive.

BRIEF DESCRIPTION OF THE DRAWINGS

The accompanying drawings illustrate a preferred embodiment of the invention and, when taken together with the description, serve to explain the principles of the invention.

In the drawings.

DETAILED DESCRIPTION OF A PREFERRED EMBODIMENT

In general, the container of the invention consists of, in the shown embodiment, a flat envelope or bag generally designated 10 which can be constructed of any desired material such as paper, sheet plastic or the like, but preferably of opaque or transparent plastic material such as polyethylene, polypropylene or the like, as well known in the art, and which is readily formable into sheet form. In the disclosed concept a thickness of the material of, for example only, between approximately 3½ mils to 8 mils, the latter for commercial strength and use, is used.

The polyethylene, or other appropriate material, previously in sheet form is folded upon itself to form a closed bottom or base 12 and side seams 14, 16. These side seams can be formed in different manners commensurate with the integrity of the construction. Heat welds in the nature of impulse welding, consisting of heat and pressure or the use of a permanent glue are contemplated. In any event, the seams or side edges 14, 16 must be of adequate strength and have such properties as to prevent their being compromised or opened. In some instances, it is contemplated that, if the material used lends itself thereto, that the seams can be either initially or subsequently sewn for strength, or fabrication or the like. In order to add strength, if desired, double panels can be used in the container.

Figures 4, 5, 6, 7A, 7B, 7C, 7D:
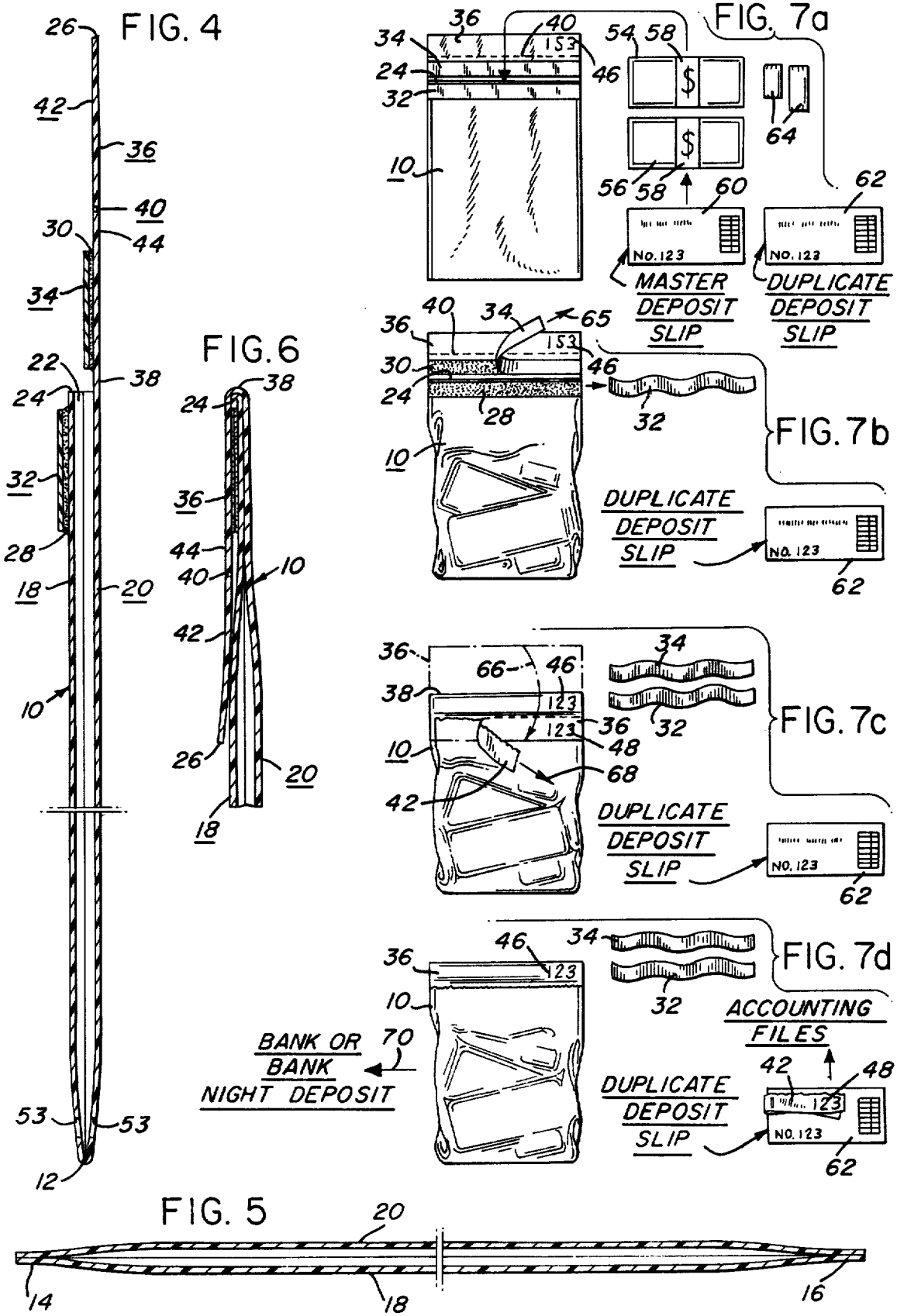
FIG. 4 is a sectional view through the bag container taken on line 4—4 of FIG. 1.
FIG. 5 is a fragmentary, enlarged, sectional view taken on line 5—5 of FIG. 1.
FIG. 6 is an enlarged, fragmentary, sectional view taken on line 6—6 of FIG. 3.
FIGS. 7A, 7B, 7C, and 7D, respectively illustratively disclose the sequence of steps followed by a user in placement of contents in the bag-like container, the closure and sealing and ultimate disposition thereof, also indicating user identification means.

The so-folded construction includes a front member or panel 18 and a back or rear panel 20, see FIG. 4, and as there shown an access opening 22. The access opening 22 is at the upper termination point or line 24 of front panel 18. The rear panel, as shown, extends upwardly to a terminal end line 26, which is substantially above front terminal line 24. It is obvious that the access opening 22 provides an opening to the interior of the so-formed bag for placement therein of any desired materials or items.

As shown in greater detail in FIG. 4, proximate to the terminal line 24 of front panel 18, a strip or layer of an adhesive material 28 is provided or juxtaposed on the surface. An adhesive layer or strip 30 is likewise placed on the interior surface of back panel 20 and is disposed at a position slightly above or higher than the access opening 22 for purposes hereinafter to be described.

The adhesive material is preferably of a pressure-sensitive type and, as supplied to the user or customer, the adhesive strips or layers are removably covered by peel-off strips 32, 34 of generally known type. A suitable adhesive material for this purpose is referred to in the art as a "contact" cement. It is also to be noted that the adhesive strips or layers 28, 30 extend completely across the respective surfaces on which placed. They are also covered in their entirety by the removable cover strips 32, 34 to prevent inadvertence of closure and sealing of the member. The adhesive material 28, 30 is of importance in the invention. It is of such a nature that it can be applied in the strips 28, 30, and temporarily or initially covered by the removable or peel-off strips 32, 34. Subsequent to insertion of contents into the interior of the container bag, however, and when it is desired to close and seal the bag, the adhesive must be such that, subsequent to juxtaposition of the two surfaces or strips 28, 30 thereof, and the application of pressure thereto, the two strips of adhesive are mated and form an immediate and permanently tamper-proof bond. A suitable material is available from Fasson Company of Painesville, Ohio, under the tradename or designation FASTAPE "L", the characteristics of which appear hereinafter. Obviously substantially identical operating adhesives can be used within the scope of the invention.

Referring again to FIGS. 4 and 6, it is noted that the rear or back panel 20 is provided with a continuity or extension 36. It will be seen that this extension carries on its forward face the adhesive strip 30. The extension, in effect, constitutes a foldable flap. Subsequent to placement of the contents in the container interior, the peelable or removable strips 32, 34 are respectively removed from their protective positionment over the adhesive strips or layers 28, 30, the extension lip or lid 36 folded over or about a line generally designated 38 in FIGS. 4 and 6, so that the adhesive in the strip 30 is brought into mating contact with the adhesive of strip 28. Upon appropriate contact and pressure, there is formed between the materials of the adhesive strips an immediate and permanent, preferably substantially solvent and water-proof bond. The strips of adhesive extend the full widths of the faces with which associated and are coextensive in width. It has been found that a dimensionally sized strip can vary somewhat, depending upon the overall size of the container, but a sufficient height and coextensive width of the adhesive strips is required in order to ensure the integrity of the seal. In use therefore, recapitulating, following insertion of the items within the bag, the covering or protective strips 32, 34 are removed, the extension or flap 36 folded over or about the line 38, and the materials of the adhesive strips 28 and 30 are brought into mating and substantially undivorceable or inseparable union one with another. It will be seen that this will constitute a closure and seal across the full width of the container.

The adhesive material, which as mentioned is available from Fasson Company of Painesville, Ohio, has desirable properties for use with the invention, such as being aggressive to contemplated plastic film with appropriate aging time; is substantially immediately and permanently aggressive when mated to itself; has excellent resistance to many inorganic solvents. It has good shelf-life charactistics and good heat resistance.

While the adhesive is not readily subject to destruction by heat, there is the possibility of distortion or relative movement of material having the layers or strips of adhesive applied thereto. It is also foreseen that entry of the closed and sealed container could be attempted by the use of adhesive solvents or the like. While some organic solvents can attack this adhesive, their use in attempting to open the seal will most likely be readily physically and visually apparent, either by distortion of the plastic material or by adversely affecting indicia placed on the container, or by destruction of the container. Therefore, when two strips are interfaced over a contacted area, a substantially permanent bond results. While the adhesive is of such a nature that it will not be destroyed upon reasonable application of heat, it might slightly distort under circumstances set out above or application or opposing directive forces to the two surfaces to which applied. Therefore, in order to provide greater integrity or security, and also to visually indicate any attempts to open the container after sealing, additional features have been incorporated into the container or bag. It is to be noted that the flap or extension 36, at the fold line 38, is provided with a substantial dimension to provide the proper fold. The extension 36 is provided with a perforation line at 40 which extends across the width thereof. By reference to FIG. 6 it will be seen that in the sealed condition of the container, the extension 36 is provided, below the perforation line 40 with a free lip portion 42. It will be noted that a slight overlap of flap extension 44 is provided between the adhesive on the back and the perforation line 40, which permits for a slight variation in application of the adhesive. That portion of the flap or lip 42 is free for movement about the perforation line 40 as will be obvious.

Figure 1:
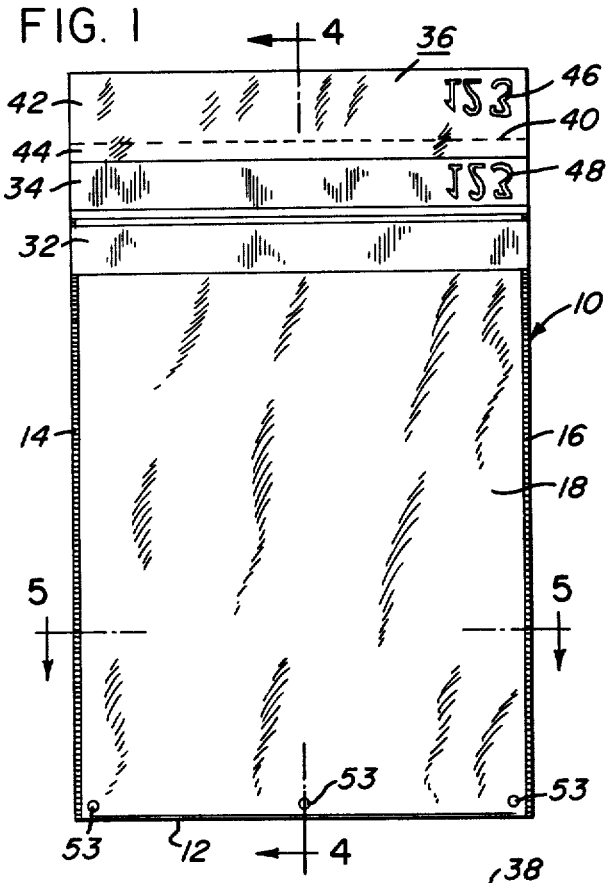
FIG. 1 is a front elevational view of a container in accordance with the invention, consisting of a bag-like construction and shown prior to insertion therein of contents and prior to closure and sealing of the bag.
Figure 2:
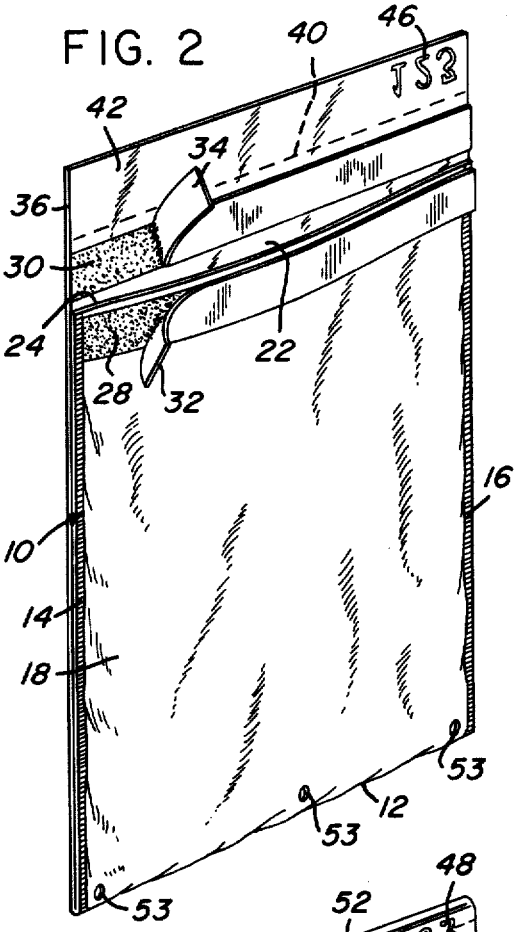
FIG. 2 is a perspective view of the bag-like container of FIG. 1 showing in greater detail features partially directed to the closure and sealing means for the bag, and deactivating coverage means therefor, to prevent inadvertent sealing of the container.
Figure 3:
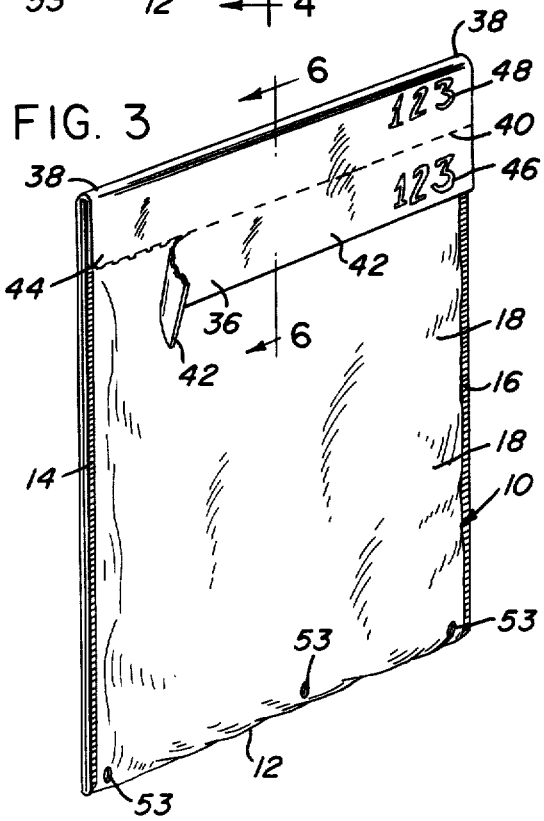
FIG. 3 is a perspective view of the bag-like container similar to FIG. 2 but showing the container after having been closed and sealed and disclosing, fragmentarily, identification means for the contents and/or user.
Figure 8:
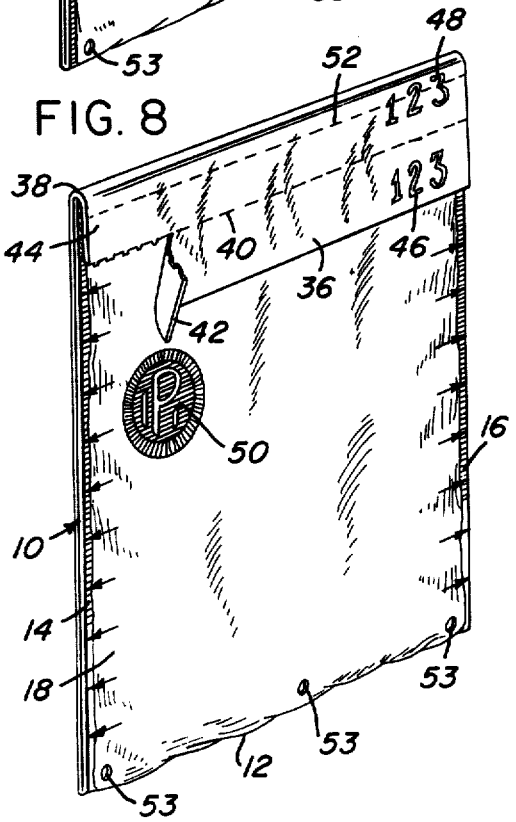
FIG. 8 shows a container having user identification.

The free lip portion 42 can be provided with indicia such as shown at 46, of any desired design or configuration, and which can serve as a user identification (see FIGS. 3 and 8). The indicia can be of a nature that will identify an individual bank depositor or customer. The bank can maintain a reference record for this purpose. Even though instructions for use placed on the container state that the customer-bag identifying indicia be put on the deposit slip and inserted in the container, failure to so include the indicia, or place the slip in the container will not prevent identification by the bank if the bank has a record of customer use indicia. Correlation of customer and container, with its contents, can accordingly be effected even if such ommissions occur. Additionally, the indicia indicated at 46, 48 can comprise part of a specific user sequence, so that the bank or the like, and the container user, can be appropriately sequenced. This permits use of record information in the absence of inclusion of a deposit slip.

As shown in FIG. 3, following the closure and sealing of the container, the free lip 42 can be removed at the perforation line 40 and this segment with the indentification indicia 46 can be retained by the user. It is also to be noted that indicia is incorporated at 48 on the back side of the extension 36, and in correct orientation to that of indicia 46, so that in the closed position shown in FIG. 3, the identifying indicia 46, 48 will be correctly positionally orientated on the container. Obviously any other identification means could be utilized. With the free lip or flap portion 42 removed and retained by the user, the sealed container can be placed in, for example, the bank night depository and the indicia at 48 remains on the so-deposited container. Bank personnel at an appropriate time, such as the following day, can then appropriately handle the contents of the so-deposited container and can readily identify the user source by an enclosed deposit slip.

Indicia of this type can also be well used by, for example, hospitals to control contents of patient's bags, for example, and to account for their use, storage and/or disposition.

As shown in FIG. 8, a user identification can be placed on the container or bag at an appropriate place as shown at 50. If desired, additional indicia can be incorporated indicating a sender source and recipient source, including names, addresses and the like.

In order to further ensure a visual indication of any attempted unauthorized entry of the container, the flap or back extension 36 can be provided in the present instance with a second perforation line at 52, FIG. 8, which is within, or bisects, the section or strip of adhesive thereon, and therefore the mated adhesive strips or sections in the closed and sealed condition. If desired, plural perforation lines may be utilized. The indicia, or other design, as at 48, is likewise disposed partially across this perforation line 52, and any material distortion of flap 36 will disrupt the specific relationship of the individual indicia or design, and will clearly indicate an attempt to tamper or unauthorizedly enter the package.

The use of additional perforation lines, such as at 52, incorporated at the adhesive area of the flap, and which perforation line extends the full width of the flap and bisects the adhesive area, lends greater integrity to the container and the contents thereof from any attempt to compromise the container. In the event that anyone should attempt to reopen the container at the flap area, following sealing, by application of heat, force, solvent or otherwise, the perforation line 52 would most likely readily tear by material distortion along the weakened line.

As an additional safeguard feature, a plurality or series of printed arrows, as shown in FIG. 8, can be placed along the outer peripheral edges of the container so that if someone cuts the container along one edge to open it, and subsequently attempts to reseal it, the arrow pattern would be disturbed. This will serve to give further notice that the container has been tampered with.

These arrows can also serve as reference points in container assembly.

As pointed out above, the present container is susceptible of many uses. For some purposes, it is desirable to provide vent or bleed holes or openings such as at 53. Such openings will permit venting of air to prevent pillowing, which might burst the container under impact or other applied force. Moisture or liquid inadvertently confined within the container can also be thereby vented.

Referring now to FIGS. 7A–7D inclusive, a sequential operational use of the container of the invention is shown and will be readily apparent. In FIG. 7A, the container 10 generally corresponds to the showing of FIG. 4. This is the open condition. The user, with the container in the open position, can place therein, if the container is to be used for a bank deposit, money, including bills or notes such as indicated at 54, 56 of different designations bound together in packages in a usual manner by binders or wrappings 58. An original deposit slip 60 and a duplicate deposit slip 62, bearing the container number, can be placed within the container, together with the bills and/or checks assembled as bundles, and coins, all as generally indicated at 64. The original deposit slip, if used, can be retained by the bank and the duplicate deposit slip either retained by the user or returned to the user from the bank. In the sequence here shown, the duplicate deposit slip 62 is retained by the user and, as shown in FIG. 7D, is attached to the removed free flap portion 42 which has the indicia 48 thereon, this serving as correlating and verifying information.

In FIG. 7B, the contents have been placed in container 10, removable strip 32 has been removed, and removable strip 34 is shown being removed from its protective adhesive covering position. Removal of strips 32,34 exposes adhesive layers 28,30, as indicated by arrow 65 in an obvious manner.

In FIG. 7C, the extension 36 has been folded over around line 38 so that the adhesive strips 28, 30 have been brought into mating and sealing position. The folding over of the flap is indicated by the arrow 66 in this figure. Additionally, as indicated by arrow 68, the tear-off portion 42 is being removed from the container following the closing and sealing thereof. This portion 42 can be retained by the depositer and/or attached to a duplicate night deposit slip (see FIG. 7D). The removed portion can also be retained by the customer for later verification of deposit of a container or for bank checking.

FIG. 7D shows the container in the fully filled, closed and sealed condition and, as indicated by arrow 70, the container is ready for or has been placed in the bank or the bank night deposit of the usual type. The duplicate deposit slip 62 and identification flap 42 are retained by the user and/or placed in appropriate accounting files for later correlation of the deposit.

While the embodiment of the invention has been specifically shown as applicable to a bank night deposit container, manifestly other and additional uses can be made of containers in accordance with the invention. Various different usages have been set forth hereinabove. The container of the invention consists of an arrangement of components which provide complete security in containers or packages not otherwise available. The containers are of low initial cost and this permits their being disposable after a single use. The material and structure provide a sufficiently strong package to withstand contemplated usages such as being deposited in night depository equipment of banks. Any place where security or integrity of property is of a vital consideration, the features of the invention can well and readily be utilized.

Manifestly, changes in the indicia or identification means incorporated, and as above described, can be varied depending upon the end use of the article.

In this disclosure, there is shown and described a preferred embodiment of the invention, but as aforementioned, it is to be understood that minor modifications can be effected within the scope of the inventive concept as expressed herein and as defined and limited solely by the appended claims.

What is claimed is:

1. A high integrity, tamper resistant security container, comprising:

(a) an enclosure formed from an overlying panel and an underlying panel, both made of a shear and impact resistant thermoplastic material and having an access opening along an edge of the enclosure for insertion of items into the enclosure;

(b) a flap formed as part of the underlying panel and extending beyond the overlying panel, which is foldable to a position juxtaposed over the overlying panel so as to close the access opening upon sealing;

(c) areas of adhesive material on each of said flap and said overlying panel formed as parallel bands substantially identical in area along and proximate to the access opening, protected by peelable strips which are removed prior to sealing the access opening, each area positioned so as to mate the flap and the overlying panel when they are pressed together and so as to produce a substantially permanent tamper resistant closure of the access opening;

wherein the flap has an end portion beyond the area of adhesive material thereon which is demarcated by a first line of perforations between the free end of the flap and the area of adhesive so that the end portion is detachable from the remainder of the flap along the first line of perforations, the end portion and the remainder of the flap each bearing identical identification indicia thereon;

and wherein the flap has a second line of perforations across the width thereof running through both the area of adhesive material, and the identification indicia thereon, the arrangement of the second line of perforations being such that attempts to open the enclosure along the access opening will disrupt the continuity of the flap and the identification indicia.

2. The container of claim 1, further comprising edge indicia on the periphery of the container, whereby opening or resealing of the container along its periphery will visually disturb the edge indicia.

* * * * *